US011219572B2

(12) United States Patent
Lim et al.

(10) Patent No.: US 11,219,572 B2
(45) Date of Patent: Jan. 11, 2022

(54) METHOD AND APPARATUS FOR CONTROLLING A WALKING ASSISTANCE APPARATUS

(71) Applicant: Samsung Electronics Co., Ltd., Suwon-si (KR)

(72) Inventors: Bokman Lim, Yongin-si (KR); Youngbo Shim, Seoul (KR); Kyung-Rock Kim, Yongin-si (KR); Jusuk Lee, Hwaseong-si (KR); Jun-Won Jang, Seoul (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 1259 days.

(21) Appl. No.: 14/682,694

(22) Filed: Apr. 9, 2015

(65) Prior Publication Data

US 2016/0101515 A1 Apr. 14, 2016

(30) Foreign Application Priority Data

Oct. 14, 2014 (KR) ..... 10-2014-0138220

(51) Int. Cl.
*A61H 3/00* (2006.01)
*A61H 1/02* (2006.01)

(52) U.S. Cl.
CPC ..... *A61H 1/0237* (2013.01); *A61H 1/0244* (2013.01); *A61H 3/00* (2013.01);
(Continued)

(58) Field of Classification Search
CPC ..... A61H 1/02; A61H 3/00; A61H 1/0262; A61H 2201/165; A61H 2230/62; B25J 9/0006; B25J 9/1664; A61B 5/112
See application file for complete search history.

(56) References Cited

U.S. PATENT DOCUMENTS 7,402,142 B2 * 7/2008 Kawai ..... B62D 57/032 600/587
8,298,164 B2 10/2012 Yasuhara
(Continued)

FOREIGN PATENT DOCUMENTS

JP 2010-104397 A 5/2010
JP 2012245211 A 12/2012
(Continued)

OTHER PUBLICATIONS

Ken Endo, et al., "Human Walking Model Predicts Joint Mechanics, Electromyography and Mechanical Economy", The 2009 IEEE/RSJ International Conference on Itelligent Robots and Systems, Oct. 11-15, 2009, pp. 4663-4668.
(Continued)

*Primary Examiner* — Justine R Yu
*Assistant Examiner* — Christopher E Miller
(74) *Attorney, Agent, or Firm* — Harness, Dickey & Pierce, P.L.C.

(57) ABSTRACT

A method and apparatus for controlling a walking assistance apparatus are provided. The apparatus may include a detector configured to detect a first step of a user, based on measured right and left hip joint angle information, a reconstructor unit configured to reconstruct knee joint information matched to the right and left hip joint angle information based on knee joint trajectory information in response to the user's steps, and a torque generator configured to generate a first torque applied to a first leg corresponding to the first step. The torque generator may generate the first torque, based on a second torque applied to a second leg that is opposite to the first leg and that corresponds to a second step preceding the first step.

20 Claims, 13 Drawing Sheets

(52) U.S. Cl.
CPC .. *A61H 2201/018* (2013.01); *A61H 2201/165* (2013.01); *A61H 2201/5061* (2013.01); *A61H 2201/5069* (2013.01); *A61H 2201/5079* (2013.01)

(56) References Cited

U.S. PATENT DOCUMENTS

2003/0093021 A1* 5/2003 Goffer ..... A61F 5/0102 602/23
2005/0177080 A1* 8/2005 Yasuhara ..... B25J 9/0006 602/16
2006/0122710 A1* 6/2006 Bedard ..... A61F 2/644 623/24
2006/0211956 A1* 9/2006 Sankai ..... A61B 5/04888 601/5
2008/0161937 A1* 7/2008 Sankai ..... A61H 3/008 623/25
2008/0234608 A1* 9/2008 Sankai ..... A61B 5/04888 601/5
2008/0249438 A1* 10/2008 Agrawal ..... A61H 1/0237 601/35
2009/0036815 A1* 2/2009 Ido ..... A61H 3/008 602/23
2009/0062884 A1* 3/2009 Endo ..... A61N 1/36003 607/49
2009/0192414 A1* 7/2009 Yasuhara ..... B25J 9/0006 600/587
2009/0222105 A1* 9/2009 Clausen ..... A61F 2/60 623/27
2009/0270766 A1* 10/2009 Yasuhara ..... A61H 3/00 600/595
2010/0121232 A1* 5/2010 Sankai ..... A61H 3/008 601/23
2010/0138043 A1* 6/2010 Kajima ..... B62D 57/032 700/261
2010/0271051 A1* 10/2010 Sankai ..... A61B 5/1038 324/679
2011/0004322 A1 1/2011 Sankai
2011/0105966 A1* 5/2011 Kazerooni ..... A61H 3/008 601/35
2011/0205067 A1* 8/2011 Konishi ..... A61H 3/008 340/573.1
2011/0264015 A1* 10/2011 Endo ..... A63B 21/4011 601/35
2011/0301756 A1* 12/2011 Yoshiike ..... B62D 57/032 700/253
2012/0016276 A1* 1/2012 Doi ..... A61H 1/024 601/34
2012/0029399 A1* 2/2012 Sankai ..... A61B 5/04888 601/40
2012/0071797 A1* 3/2012 Aoki ..... A61H 3/00 601/34
2012/0172770 A1* 7/2012 Almesfer ..... B25J 9/0006 601/35
2012/0215140 A1* 8/2012 Hirata ..... A61H 1/0244 601/35
2012/0226203 A1* 9/2012 Nakashima ..... A61H 3/00 601/34
2012/0259431 A1* 10/2012 Han ..... A61H 1/024 623/24
2012/0310122 A1* 12/2012 Endo ..... A61H 1/0244 601/35
2013/0012852 A1* 1/2013 Imaida ..... A61F 5/01 602/16
2013/0138020 A1* 5/2013 Yasuhara ..... A61H 3/00 601/35
2013/0158445 A1* 6/2013 Kazerooni ..... A61H 3/00 601/35
2014/0121575 A1* 5/2014 Yasuhara ..... A61H 3/00 601/35
2014/0142475 A1* 5/2014 Goldfarb ..... A61H 3/00 601/35
2014/0221894 A1* 8/2014 Nagasaka ..... A61H 3/00 602/23
2015/0025423 A1* 1/2015 Caires ..... A61H 1/024 601/35
2015/0173993 A1* 6/2015 Walsh ..... A61H 1/024 414/4
2015/0182408 A1* 7/2015 Roh ..... A61H 3/00 482/51
2015/0366738 A1* 12/2015 Endo ..... A61H 3/00 482/4
2015/0366739 A1* 12/2015 Endo ..... A61H 3/00 482/4
2015/0366740 A1* 12/2015 Endo ..... A61H 3/00 623/24
2016/0331625 A1* 11/2016 Sankai ..... B25J 9/0006
2016/0338897 A1* 11/2016 Takenaka ..... A61H 3/00

FOREIGN PATENT DOCUMENTS

JP 2012245212 A 12/2012
JP 2013111408 A 6/2013
JP 2014073227 A 4/2014
JP 5494218 B2 5/2014
KR 0941115 B1 2/2010
KR 10-2012-0069920 A 6/2012
KR 20130093201 A 8/2013
KR 1317354 B1 10/2013
KR 10-2015-0053065 5/2015

OTHER PUBLICATIONS

Conor James Walsh et al., "An autonomous, underactuated exo-skeleton for load-carrying augmentation", 2006 IEEE/RSJ International Conference of Intelligent Robots and Systems Oct. 9-15, 2006, Bejing, China, pp. 1410-1415.
KR Office Action for corresponding Korean Patent Application No. 10-2014-0138220 dated Mar. 17, 2021 and English translation thereof.

* cited by examiner

METHOD AND APPARATUS FOR CONTROLLING A WALKING ASSISTANCE APPARATUS

CROSS-REFERENCE TO RELATED APPLICATION

This application claims the priority benefit of Korean Patent Application No. 10-2014-0138220, filed on Oct. 14, 2014, in the Korean Intellectual Property Office, the disclosure of which is incorporated herein by reference in its entirety.

BACKGROUND

1. Field

Example embodiments relate to a method and apparatus for controlling a walking assistance apparatus, and more particularly, to a method and apparatus for recognizing a gait motion based on the joint angle information of a user sensed by, for example, a walking assistance apparatus, and for controlling the walking assistance apparatus.

2. Description of the Related Art

A person wearing a walking assistance apparatus may receive assistance to the person's muscular strength while the person is walking. The assistance of muscular strength provided by the walking assistance apparatus may enhance the person's ability to walk and may enable a person who is normally unable to walk to walk.

Additionally, a person who has been immobilized for a long period of time may have suffered from atrophy of the person's leg muscles, or may find their sense of balance reduced. Accordingly, the person may suffer accidents, such as a fall, more frequently, and additional reduction in the person's walking ability may occur. For example, an elderly person suffering from osteoporosis who has difficulty walking will likely suffer from a decreased ability to walk stably, which increases their chances for falling, which then increases their chances for suffering a physical injury that may further decrease their ability to walk.

SUMMARY

Some example embodiments relate to an apparatus for controlling a walking assistance apparatus.

Accordingly, an apparatus for controlling a walking assistance apparatus may be provided that enhances the walking stability of a user by controlling the walking assistance apparatus, as well as providing walking assistance through the walking assistance apparatus.

In some example embodiments, the apparatus may include a detector configured to detect a first step of a user, based on measured right and left hip joint angle information, and a torque generator configured to generate a first torque based on a second torque, the first torque being applied to a first leg corresponding to the first step, and the second torque being applied to a second leg corresponding to a second step preceding the first step.

The detector may detect a step transition from the second step to the first step.

The torque generator may determine a profile of the first torque, based on the second torque. The torque generator may determine a point in time at which the first torque is applied, a point in time at which the first torque reaches a peak, and a duration of the first torque, based on the second torque.

The apparatus may further include a reconstructor unit configured to reconstruct knee joint information matched to the right and left hip joint angle information based on knee joint trajectory information in response to walking.

The detector may detect a landing point in time of a foot of the user, based on the reconstructed knee joint information. The torque generator may determine a point in time at which the first torque is applied as a landing point in time of a foot of the second leg.

The torque generator may determine a point in time at which the first torque reaches a peak as a point in time at which a hip joint angular acceleration of the second leg has a maximum value.

The detector may detect the first step using a finite state machine (FSM) including states based on a gait cycle. A transition condition between the states may be set based on right and left hip joint angles or right and left hip joint angular velocities at points at which the right and left hip joint angles or the right and left hip joint angular velocities cross.

The first torque may include a torque to push a leg and a torque to pull a leg. The torque to pull a leg may be generated based on the second torque, and the torque to push a leg may be estimated based on the torque to pull a leg.

Some example embodiments relate to a method of controlling a walking assistance apparatus.

In some example embodiments, the method may include detecting a first step of a user, based on measured right and left hip joint angle information, and generating a first torque applied to a first leg corresponding to the first step. The generating may include generating the first torque based on a second torque, the second torque being applied to a second leg corresponding to a second step preceding the first step.

The generating may include determining a profile of the first torque, based on the second torque, and determining, based on the second torque, a point in time at which the first torque is applied, a point in time at which the first torque reaches a peak, and a duration of the first torque.

The method may further include reconstructing knee joint information matched to the right and left hip joint angle information, based on knee joint trajectory information in response to walking.

The detecting may include detecting a landing point in time of a foot of the user, based on the reconstructed knee joint information. The generating may include determining a point in time at which the first torque is applied as a landing point in time of a foot of the second leg.

The generating may include determining a point in time at which the first torque reaches a peak as a point in time at which a hip joint angular acceleration of the second leg has a maximum value.

The detecting may include detecting the first step using an FSM including states based on a gait cycle.

BRIEF DESCRIPTION OF THE DRAWINGS

The foregoing and other features of some example embodiments will be apparent from the more particular description of non-limiting embodiments, as illustrated in the accompanying drawings in which like reference characters refer to like parts throughout the different views. The drawings are not necessarily to scale, emphasis instead being placed upon illustrating principles of some example embodiments. In the drawings.

DETAILED DESCRIPTION

Figure 1:
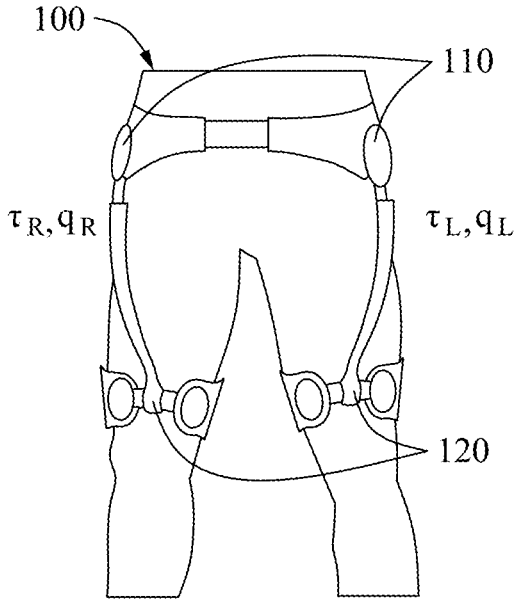
FIG. 1 illustrates a user wearing a walking assistance apparatus according to some example embodiments.

Hereinafter, some example embodiments will be described in detail with reference to the accompanying drawings. Example embodiments, may, however, be embodied in many different forms and should not be construed as being limited to the embodiments set forth herein; rather, these example embodiments are provided so that this disclosure will be thorough and complete, and will fully convey the scope of some example embodiments to those of ordinary skill in the art. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

It should be understood, however, that there is no intent to limit this disclosure to the particular example embodiments disclosed. On the contrary, example embodiments are to cover all modifications, equivalents, and alternatives falling within the scope of the example embodiments. Like numbers refer to like elements throughout the description of the figures.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected", "coupled", or "joined" to another component, a third component may be "connected", "coupled", and "joined" between the first and second components, although the first component may be directly connected, coupled or joined to the second component.

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. Also, terms used herein are selected from general terms being used in the related arts. Yet, the meanings of the terms used herein may be changed depending on a change and/or development of technologies, a custom, or preference of an operator in the art. Accordingly, the terms are merely examples to describe the example embodiments, and should not be construed as limited to the technical idea of the present disclosure.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Various example embodiments will now be described more fully with reference to the accompanying drawings in which some example embodiments are shown. In the drawings, the thicknesses of layers and regions are exaggerated for clarity.

FIG. 1 illustrates a user wearing a walking assistance apparatus 100 according to some example embodiments.

The walking assistance apparatus 100 may assist the movement of a swinging leg and a standing leg while a user is walking in order to reduce muscular strength consumption or to facilitate a correct pose. FIG. 1 illustrates an example of a hip-type walking assistance apparatus, however, there is no limitation thereto. Accordingly, the walking assistance apparatus may be, for example, a walking assistance apparatus for supporting an entire pelvic limb, or a walking assistance apparatus for supporting a portion of a pelvic limb. Also, the walking assistance apparatus may be applicable to, for example, all types of walking assistance apparatuses for assisting the walking of a user, for example, a walking assistance apparatus for supporting a portion of a pelvic limb, a walking assistance apparatus for supporting a user's knee area, and a walking assistance apparatus for supporting a user's ankle area. Furthermore, it will be obvious to one of ordinary skill in the art that the walking assistance apparatus may be applicable to an apparatus for assisting the physical rehabilitation of a user by, for example, assisting the strengthening of a user's leg muscles by enabling the user to walk without the user having to support the entirety of their body weight.

Additionally, while the assistance apparatus is referred to as a walking assistance apparatus in accordance with discussion of example embodiments, the example embodiments presented herein are not limited thereto and may also be applied to other types or forms of physical assistance apparatuses, such as apparatuses designed to assistance a user's arm movements and/or functionality, or apparatuses designed to provide additional physical strength to a user's movements. Further, while example embodiments are discussed in reference to use by a human being, one of ordinary skill in the art would appreciate that the example embodiments disclosed herein may also be applied to other beings and/or objects, such as animals, machines and/or robots, including surgical robots, assembly line/industrial robots, or autonomous robots.

Referring again to FIG. 1, a driver 110 may be configured to provide torques τR and τL as motion assistance to a right hip joint and a left hip joint of the user, and may be disposed on, for example, a right hip portion and a left hip portion of the user. Additionally, the driver 110 may measure hip joint angle information qR and qL for both hip joints of the user while the user is walking.

The torques τR and τL provided by the driver 110 may apply a force to pull or push a leg of the user through a transferring unit 120 disposed in an upper portion of a knee. Additionally, the sensed, measured, or estimated user's motion state, the muscular activation state, and the provided torque may be monitored by, for example, a separate mobile remote apparatus.

Figure 2:
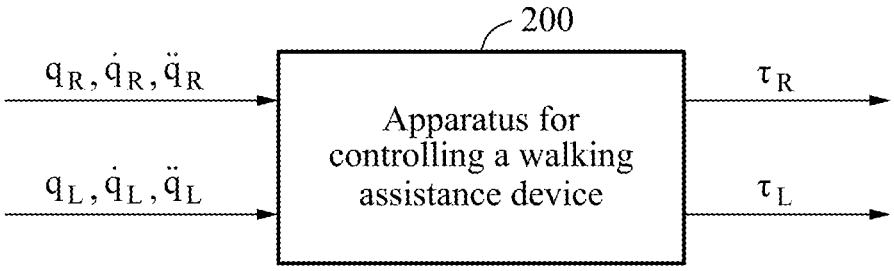
FIG. 2 illustrates an input and output relationship of an apparatus for controlling a walking assistance apparatus according to some example embodiments.

FIG. 2 illustrates an input and output relationship of an apparatus 200 for controlling a walking assistance apparatus according to some example embodiments.

The apparatus 200 may sense (or measure) the movements of both hip joints of a user wearing a walking assistance apparatus, may verify the gait motion intention of the user based on the movements, and may provide the user with a torque for an appropriate amount of walking assistance.

The angles qR, and qL for either hip joint may be measured using a sensing unit (not pictured), where the sensing unit may be, for example, a location sensor. Angular velocities qR' and qL' and angular accelerations qR" and qL" for either hip joints may be measured, or calculated as a difference in a joint angle.

The apparatus 200 may verify the gait motion intention of the user based on measured hip joint angle information for either hip joint, and may generate a torque for a walking assistance apparatus suitable for the user. The generated torque may be transferred to the driver 110 of FIG. 1, and may be provided to either hip joint, or both hip joints.

Figure 3:
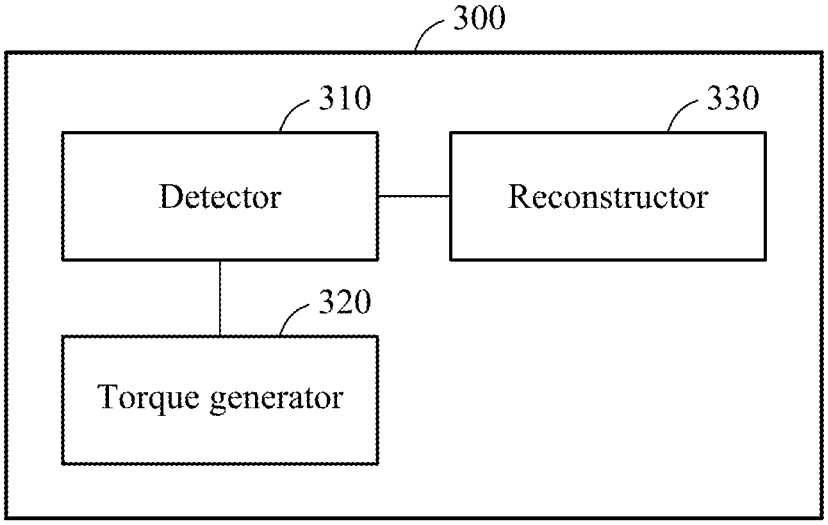
FIG. 3 is a block diagram illustrating a configuration of an apparatus for controlling a walking assistance apparatus according to some example embodiments.

FIG. 3 is a block diagram illustrating a configuration of an apparatus 300 for controlling a walking assistance apparatus according to some example embodiments.

Referring to FIG. 3, the apparatus 300 may include a detector 310, a torque generator 320, and a reconstructor 330.

The detector 310 may detect a first step of a user, based on measured right and left hip joint angle information. As described above, the angles qR, and qL for either hip joint of the user may be measured by a sensing unit, where the sensing unit may be, for example, a location sensor.

The detector 310 may recognize sequential discrete walking events, and may determine a walking state of the user. For example, the detector 310 may detect the first step using a finite state machine (FSM) that includes walking states corresponding to a gait cycle.

A transition condition between the states in the FSM may be set based on the right and left hip joint angles and/or right and left hip joint angular velocities at the points at which the right and left hip joint angles and/or the right and left hip joint angular velocities cross.

The FSM used to detect the first step in the detector 310 may refer to a model to recognize a walking state and a main walking event. For example, the FSM may sense six events sequentially occurring during walking. Additionally, a period of time in which each state is maintained, and a state transition condition may be updated, and may be used to control a walking assistance apparatus.

Based on the above-described transition condition, the states in the FSM may be classified as, for example, a state in which a left leg swings while a right leg remains standing, a state in which a left leg starts swinging while a right leg lands, a state in which a right leg swings while a left leg remains standing, and a state in which a right leg starts swinging while a left leg lands.

Accordingly, the detector 310 may determine a walking state of a user, using the FSM, and may detect a point at which every step starts. In other words, the detector 310 may detect a transition from a second step preceding the first step to the first step.

Additionally, detector 310 may detect a landing point in time of a foot of a user based on reconstructed knee joint information. For example, a hip-type walking assistance apparatus may not include a sensing unit to directly measure knee joint information. In other words, the hip-type walking assistance apparatus may not directly measure the knee joint information. In addition, because a walking assistance apparatus for supporting a user's knee area does not include a sensing unit to directly measure ankle joint information, the ankle joint information may not be directly measured.

Thus, whenever it is difficult to measure joint information on a second joint, the joint information may be reconstructed based on the trajectory information of the second joint that was previously measured by the detector 310 or was stored in the reconstructor 330 in advance. The reconstructor 330 may restore or reconstruct a motion of the second joint that may not have been measured due to lack of a sensor.

In the following description, the reconstruction of knee joint information is described in more detail, however, the reconstruction process is not limited thereto and is only discussed in reference to knee joint information for clarity's sake. For example, unmeasurable information on another joint, for example, an ankle joint, may be reconstructed using the same techniques. A method of reconstructing knee joint information will be further described with reference to FIG. 8.

The detector 310 may detect a landing point in time of a foot of a user, based on the knee joint information reconstructed by the reconstructor 330, and may transfer information regarding the detected landing point in time to the torque generator 320. The torque generator 320 may determine a point in time at which a generated first torque is applied as the landing point in time of a foot of a second leg that is opposite the first leg and that corresponds to the second step.

Accordingly, the apparatus 300 may generate a torque applied to the first leg corresponding to the detected first step, and may control a walking assistance apparatus for the user. A method by which the detector 310 detects the first step using the FSM will be further described with reference to FIGS. 4 through 6.

The torque generator 320 may generate the first torque applied to the first leg corresponding to the detected first step. The torque generator 320 may generate the first torque based on a second torque applied to the second leg.

In other words, the torque generator 320 may use torque information on a torque applied at a previous step to generate a torque to be applied at a current step. The torque generator 320 may determine a profile of the first torque, based on the second torque applied at the second step preceding the detected first step. Because the second step and the first step sequentially occur, the first step may have continuity with the second step. Accordingly, the profile of the first torque may be determined based on the second torque.

The torque generator 320 may determine, based on the second torque, a point in time at which the first torque is applied, a point in time at which the first torque reaches a peak, and a time duration of the first torque. For other parameters required to generate the first torque, a desired and/or preset value, or a value obtained by modifying or optimizing a separate parameter may be used.

The torque generator 320 may determine the point in time at which the first torque is applied as the landing point in time of the foot of the second leg. The first torque may be applied to the first leg at the detected first step and accordingly may need to be applied at a point in time of a transition from the second step to the first step.

Accordingly, when the second leg lands, a swing of the first leg for the first step may be started, and the point in time at which the first torque is applied may be determined as the landing point in time of the foot of the leg.

The torque generator 320 may determine the point in time at which the first torque reaches a peak as a point in time at which a hip joint angular acceleration of the second leg has a maximum value. As described above, the first step may have continuity with the second step because the second step and the first step sequentially occur. Accordingly, the point in time at which the hip joint angular acceleration of the second leg has the maximum value may be determined as the point in time at which the first torque reaches its peak and thus it is possible to control the steps of the user so that they have regularity.

The torque generator 320 may also determine the duration of the first torque based on the second torque. Accordingly, the continuity between the second step and the first step may be maintained and thus, it is possible to control the steps of the user so that they have regularity.

The first torque generated by the torque generator 320 may include a torque to push a leg and a torque to pull a leg (hereinafter, respectively referred to as a pushing torque and a pulling torque). A force to push a leg and a force to pull a leg may be simultaneously generated while a user is walking and accordingly the generated first torque may also include the pushing torque and the pulling torque. The pulling torque may be generated based on the second torque and the pushing torque may be estimated based on the pulling torque.

Unlike with the pulling torque, the pushing torque may has a high probability of suffering from a power transfer loss because the first torque is generated in a state in which a great torque is already applied as a force to the user's lower abdomen instead of assisting with the pushing torque. Accordingly, to increase and/or maximize the effect of the pulling torque, in other words, to decrease and/or minimize the reduction in the user's step length (i.e., stride), the pushing torque may be estimated based on the pulling torque.

As described above, the apparatus 300 may generate a torque for a current step, based on a torque applied at a previous step, for each of the user's steps. Thus, it is possible to assist regular walking and to enhance walking stability.

Figure 4:
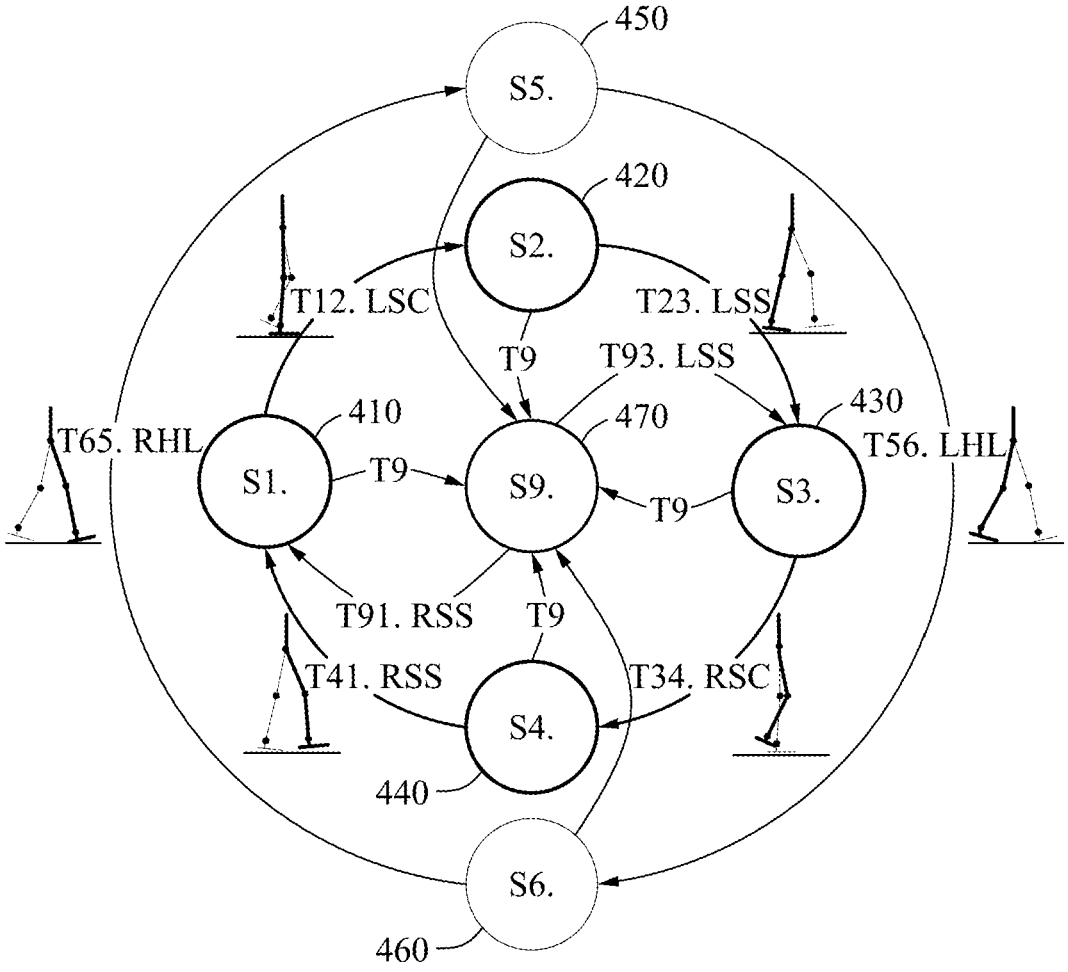
FIG. 4 illustrates a finite state machine (FSM) to detect a first step according to some example embodiments.

FIG. 4 illustrates an FSM to detect a first step according to some example embodiments.

The FSM of FIG. 4 may include walking states based on a gait cycle. The FSM may be used by the detector 310 of FIG. 3 to detect a first step. A transition condition in the FSM may be set based on right and left hip joint angles and/or right and left hip joint angular velocities at points at which the right and left hip joint angles and/or the right and left hip joint angular velocities cross.

For example, a zero-crossing event may be used. The zero-crossing event may include, for example, an event in which the difference between both hip joint angles passes through a zero point when both legs cross, and an event in which an angular velocity of a leg passes through a zero point when the swing direction of the leg is changed.

Additionally, the transition condition may be set based on the knee joint angle. For example, a zero-crossing event could occur when one knee is bent and the other knee is straightened and the difference between the angles of the knees passes through a zero point. By using the FSM, use of a threshold value may be decreased.

For example, in a state S1 410, the right leg is swinging while the left leg lands on the ground. When an event in which the right leg and the left leg cross occurs while the FSM is in the state S1 410, the state S1 410 may transition to state S2 420 in which the left leg swings while the right leg remains standing.

The event in which the right leg and the left leg cross may occur when the left leg swings the right leg remains standing. Accordingly, the left hip joint angle and the right hip joint angle may cross. Therefore, the difference between the left hip joint angle and the right hip joint angle may pass through a zero point which may trigger transition condition T12.

In the state S2 420, the left leg swings while the right leg remains standing. When an event to stop the swing of the left leg occurs in the state S2 420, the state S2 420 may transition to a state S3 430 in which the left leg stops swinging while the right leg remains standing on the ground.

The event to stop the swing of the left leg may occur when the left leg lands on the ground. In the event to stop the swing of the left leg, a left hip joint angular velocity may pass through a zero point, which may be set as a transition condition T23.

In the state S3 430, the left leg stops swinging while the right leg remains standing on the ground. When an event in which the right leg and the left leg cross occurs in the state S3 430, the state S3 430 may transition to a state S4 440 in which the right leg swings while the left leg remains standing.

The event in which the right leg and the left leg cross may occur when the right leg swings while the left leg remains standing. Accordingly, the right hip joint angle and the left hip joint angle may cross. The difference between the right hip joint angle and the left hip joint angle may pass through a zero point, which may be set as transition condition T34.

In the state S4 440, the right leg swings while the left leg remains standing. When an event to stop the swing of the right leg occurs in the state S4 440, the state S4 440 may transition to the state S1 410.

The event to stop the swing of the right leg may occur when the right leg lands on the ground. In the event to stop the swing of the right leg, a right hip joint angular velocity may pass through a zero point, which may be set as a transition condition T41.

As described above, a left step may be caused by a transition from the state S2 420 to the state S3 430, and a right step may be caused by a transition from the state S4 440 to the state S1 410. Accordingly, the detector 310 may detect transitions to the states S1 410 and S3 430, and thus may detect every step that the user takes.

Additionally, the detector 310 may detect a landing point in time of a foot of the user, based on the knee joint information reconstructed by the reconstructor 330 of FIG. 3. In a state S5 450, the right leg is standing. When an event in which the right foot lands occurs in a state S6 460, the state S6 460 may transition to the state S5 450. Similarly, in the state S6 460, the left leg is standing. When an event in which the left foot lands occurs in the state S5 450, the state S5 450 may transition to the state S6 460.

Transition conditions T56 and T65 between the states S5 450 and S6 460 may use a zero-crossing condition that occurs when one knee is bent and the other knee is straightened during landing where the difference between angles of the knees passes through a zero point. Accordingly, the detector 310 may detect transitions to the states S5 450 and S6 460, and may detect the landing point in time of the foot.

When the difference between a right hip joint angle and a left hip joint angle, and the difference between a right hip joint angular velocity and a left hip joint angular velocity are equal to or less than a desired threshold, or when a period of time in which each state is maintained is equal to or greater than a desired period of time, a situation in which walking stops or an exceptional situation may be recognized and a transition to exception state S9 470 may be performed.

As shown in FIG. 4, in order to recognize the exception state S9 470, all states may transition to the exception state S9 470. Additionally, when a transition condition T91 from the exception state S9 470 to the state S1 410, and a transition condition T93 from the exception state S9 470 to the state S3 430 are satisfied, the exception state S9 470 may transition to each of the states S1 410 and S3 430.

To recognize the exception state S9 470 in a fast gait motion, all walking states may transition to the exception state S9 470. However, the exception state S9 470 may transition only to the states S1 410 and S3 430 in which each step starts. To apply a torque to assist fast walking while guaranteeing walking safety, the FSM may be set so that the exception state S9 470 may transition to the states S1 410 and S3 430.

Figure 5:
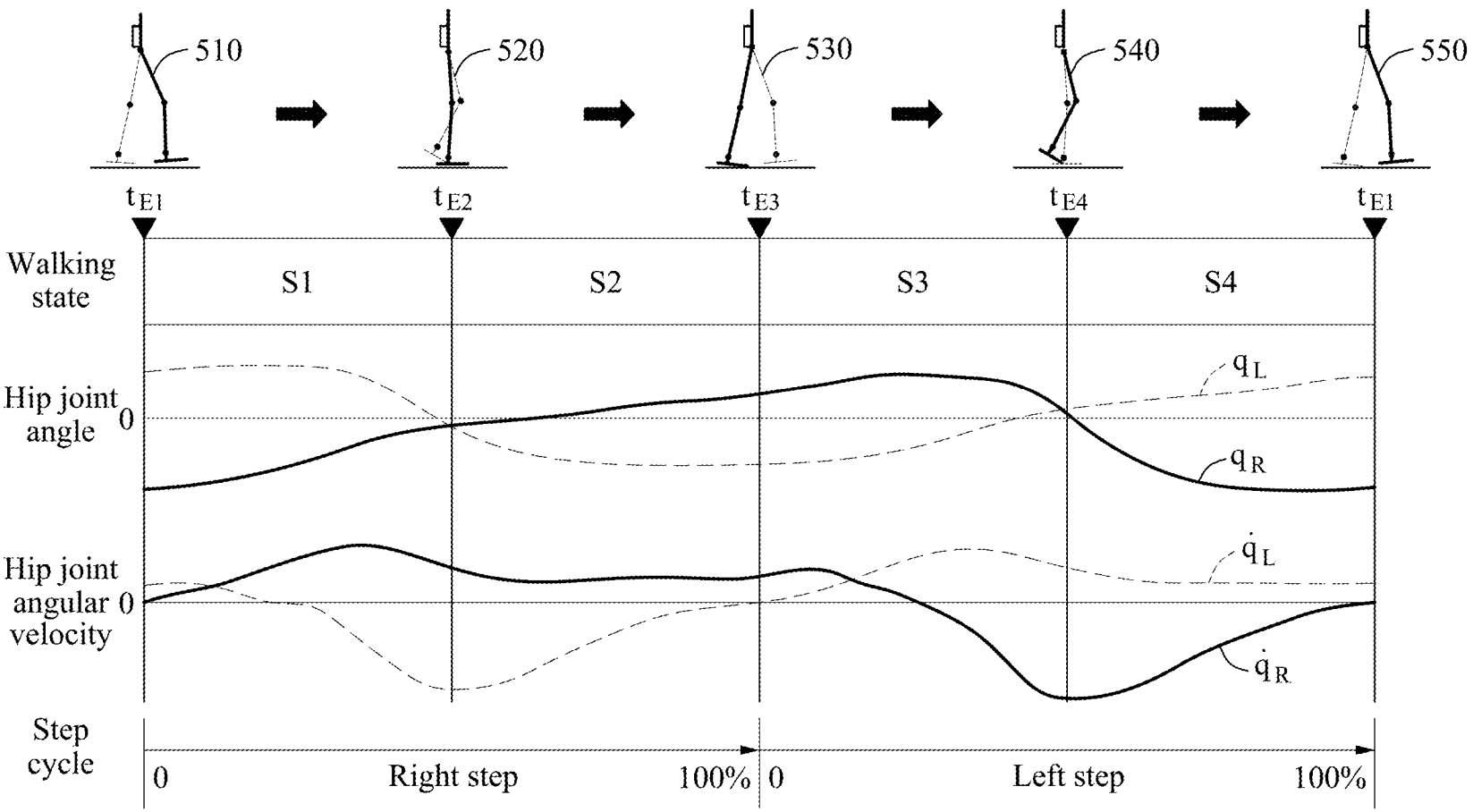
FIG. 5 is a graph illustrating a relationship between a hip joint angle, a hip joint angular velocity and a transition between states included in an FSM according to some example embodiments.

FIG. 5 is a graph illustrating a relationship between a hip joint angle, a hip joint angular velocity, and a transition between states included in an FSM according to some example embodiments.

FIG. 5 illustrates a relationship between a hip joint angle, a hip joint angular velocity and a transition between states S1, S2, S3 and S4 in an FSM. As described above, the transition between the states S1 through S4 may be set based on the right and left hip joint angles, or the right and left hip joint angular velocities, at points at which the right and left hip joint angles, or the right and left hip joint angular velocities, cross.

For example, a zero-crossing event may be used. The zero-crossing event may include, for example, an event in which the difference between both hip joint angles passes through a zero point, and an event in which an angular velocity of a leg passes through a zero point when the swing direction of the leg is changed.

Referring to FIG. 5, a transition condition 510 may correspond to an event to stop the swing of a right leg, which may occur when the right leg lands on the ground. The right hip joint angular velocity may pass through a zero point, which may be set as the transition condition 510. As shown in the hip joint angular velocity graph of FIG. 5, the transition between states may occur at the point at which the value of the right hip joint angular velocity passes through a value of "0."

A transition condition 520 may correspond to an event in which the right leg and the left leg cross, which may occur when the left leg swings while the right leg remains standing. When the left leg swings, the left hip joint angle and the right hip joint angle may cross. Accordingly, the difference between the left hip joint angle and the right hip joint angle may pass through a zero point, which may be set as the transition condition 520. As shown in a hip joint angle graph of FIG. 5, a transition between states may occur at the point at which the left hip joint angle and the right hip joint angle cross.

A transition condition 530 may correspond to an event to stop the swing of the left leg, which may occur when the left leg lands on the ground. The left hip joint angular velocity may pass through a zero point, which may be set as the transition condition 530. As shown in the hip joint angular velocity graph of FIG. 5, a transition between states may occur at a point at which the value of the left hip joint angular velocity passes through a value of "0."

A transition condition 540 may correspond to an event in which the right leg and the left leg cross, which may occur when the right leg swings while the left leg remains standing. When the right leg swings, the right hip joint angle and the left hip joint angle may cross. Accordingly, the difference between the right hip joint angle and the left hip joint angle may pass through a zero point, which may be set as the transition condition 540. As shown in the hip joint angle graph of FIG. 5, a transition between states may occur at a point at which the left hip joint angle and the right hip joint angle cross.

Walking states may continue to be sequentially repeated based on a gait motion of a user and accordingly, a transition condition 550 may be identical to the transition condition 510.

For example, the detector 310 of FIG. 3 may detect every steps of a user using an FSM including states based on a gait cycle. The detector 310 may detect transitions to the states S1 410 and S3 430 of FIG. 4 and thus may detect the steps of a user.

Figure 6:
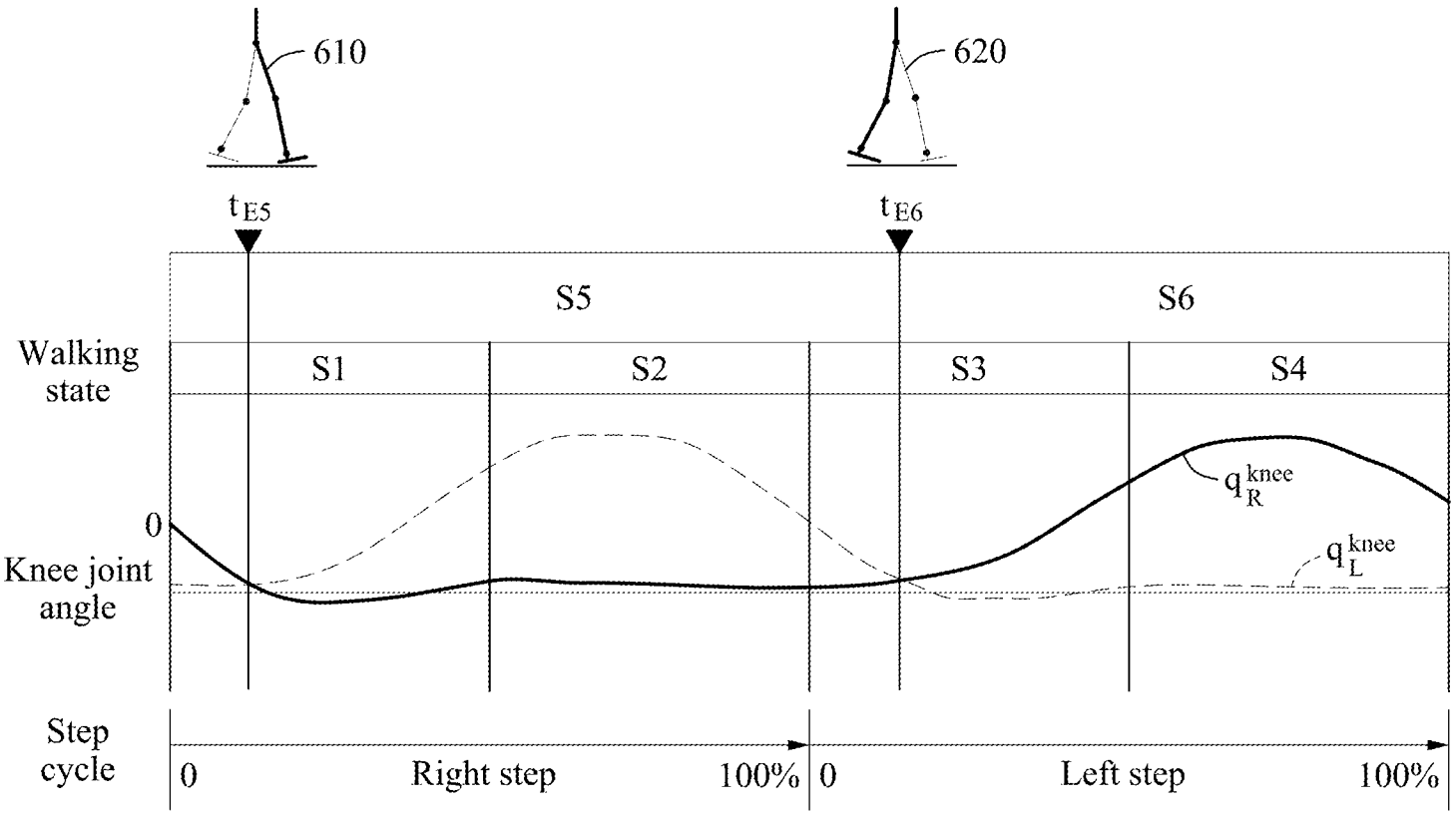
FIG. 6 is a graph illustrating a relationship between a knee joint angle and a transition between states included in an FSM according to some example embodiments.

FIG. 6 is a graph illustrating a relationship between a knee joint angle and a transition between states included in an FSM according to some example embodiments.

FIG. 6 illustrates a relationship between a knee joint angle and a transition between states S5 and S6 included in an FSM. As described above, the transition between the states S5 and S6 may use a zero-crossing event in which a difference between angles of both knees when one knee is bent and the other knee is straightened during landing passes through a zero point.

A transition condition 610 may correspond to an event in which the right foot lands, and the right knee joint angle and the left knee joint angle may cross. Accordingly, the difference between the right knee joint angle and the left knee joint angle may pass through a zero point, which may be set as the transition condition 610.

A transition condition 620 may correspond to an event in which the left foot lands, and the right knee joint angle and the left knee joint angle may cross. Accordingly, the difference between the right knee joint angle and the left knee joint angle may pass through a zero point, which may be set as the transition condition 620.

For example, the detector 310 of FIG. 3 may detect a landing point in time of a foot of a user using an FSM including states based on a gait cycle. The detector 310 may detect transitions to the states S5 450 and S6 460 and may detect the landing point in time of the foot of the user.

Figure 7:
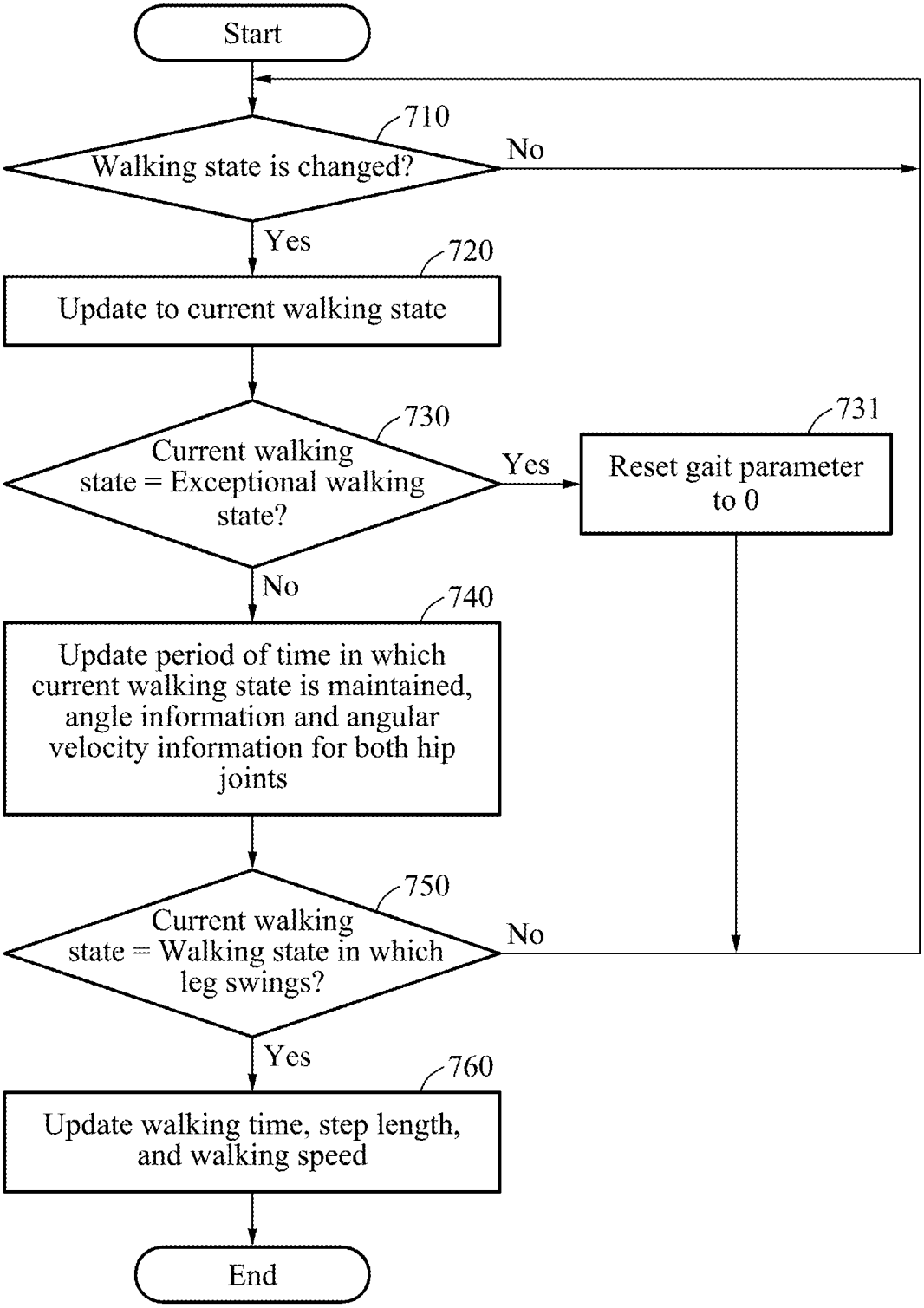
FIG. 7 is a flowchart illustrating a method of detecting a first step and updating a parameter of the first step according to some example embodiments.

FIG. 7 is a flowchart illustrating a method of detecting a first step and updating a parameter of the first step according to some example embodiments.

The torque generator 320 of FIG. 3 may generate a first torque based on a second torque. The first torque may be applied to a first leg corresponding to a first step, and the second torque may be applied to a second leg corresponding to a second step preceding the first step. Accordingly, to generate a torque for a step following the first step, the parameter of the first step may need to be updated.

Referring to FIG. 7, in operation 710, whether a walking state is changed may be determined. Because the detector 310 of FIG. 3 may detect the first step based on a change in the walking state, whether the walking state is changed may be determined first.

When the walking state is determined to have changed, the walking state of a user may be updated to the changed walking state, that is, a current walking state in operation 720. In operation 730, whether the current walking state is an exceptional walking state may be determined. Because the exceptional walking state does not correspond to a normal gait motion, a gait parameter may need to be adjusted.

When the current walking state is determined to be in the exceptional walking state, the gait parameter may be reset to "0" in operation 731. Because the exceptional walking state is not a normal walking state, a gait parameter in an exceptional state may not be used to generate a torque applied to a following step. Accordingly, the gait parameter may be reset to "0."

When the current walking state is determined not to be in the exceptional walking state, a period of time in which the current walking state is maintained, angle information and angular velocity information for both hip joints may be updated in operation 740. Accordingly, information in the current walking state may be updated.

In operation 750, whether the current walking state is a walking state in which a leg swings may be determined. As described above, a left step may be caused by the transition from the state S2 420 to the state S3 430, and a right step may be caused by the transition from the state S4 440 to the state S1 410.

Accordingly, the detector 310 may detect all steps of the user by detecting transitions to the states S1 410 and S3 430. For example, a walking state in which a leg swings may transition to the states S1 410 and S3 430 of FIG. 4.

When the current walking state is determined to be the walking state in which the leg swings, a walking time, a step length, and a walking speed may be updated in operation 760. In the walking state in which the leg swings, the first step may be detected. The above-described parameters of the first step may be updated, and the updated parameters may be used to generate a torque in a step following the first step.

Gait parameters may be updated for each step, and the updated gait parameters may be used to generate a torque in a following step. Accordingly, it is possible to control every step of a user to have regularity.

Figure 8:
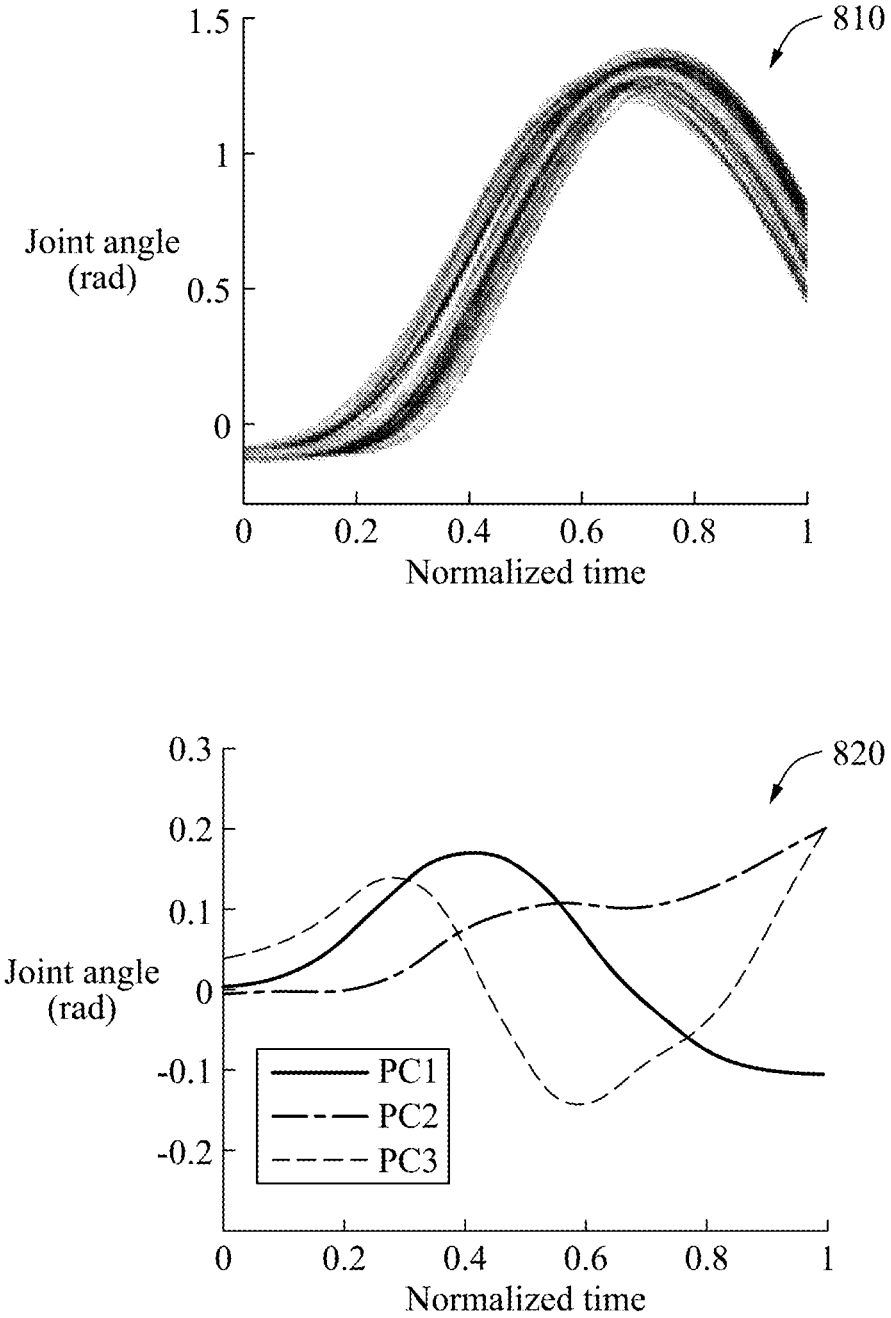
FIG. 8 is a graph illustrating a knee joint trajectory, and an extracted principal component of the knee joint trajectory according to some example embodiments.

FIG. 8 is a graph illustrating a knee joint trajectory, and an extracted principal component of the knee joint trajectory according to some example embodiments.

When it is difficult to directly measure a knee joint using a walking assistance apparatus, a principal component of the knee joint trajectory may be extracted through a principle component analysis (PCA) of a variety of knee joint trajectory data captured in advance. Based on the extracted principle component, knee joint information may be restored or reconstructed.

A graph 810 of FIG. 8 shows a variety of knee joint trajectory data captured in advance. The knee joint trajectory data based on a gait motion may be captured as shown in the graph 810.

A graph 820 shows a principle component of a knee joint trajectory extracted through a PCA of the knee joint trajectory data shown in the graph 810.

Knee joint information may be generated through linear interpolation as shown in Equation 1 of the extracted principle component.

$$q_{rec}(t)=x_1\mathrm{PC1}(t)+x_2\mathrm{PC2}(t)+x_3\mathrm{PC3}(t)+\bar{q}(t) \quad \text{[Equation 1]}$$

In Equation 1, $q_{rec}$ denotes reconstructed or restored knee joint information, $x_i$ denotes a weighting value determined based on a boundary condition, PCi denotes an extracted principle component of a knee joint trajectory, and $\bar{q}$ denotes an average trajectory of the captured knee joint data.

The boundary condition may be matched to both hip joint angles that are sensed and stored during switching of a walking state. A weighting value may be determined based on a knee joint boundary condition most similar to the sensed hip joint angles, using Equation 2 shown below.

$$\begin{bmatrix} PC1_i & PC2_i & PC3_i \\ PC1_m & PC2_m & PC3_m \\ PC1_f & PC2_f & PC3_f \end{bmatrix} \begin{bmatrix} x_1 \\ x_2 \\ x_3 \end{bmatrix} = \begin{bmatrix} q_i - \bar{q}_i \\ q_m - \bar{q}_m \\ q_f - \bar{q}_f \end{bmatrix} \quad \text{[Equation 2]}$$

In Equation 2, i denotes an initial condition, m denotes a middle condition, and f denotes a final condition. By determining the weighting value, the knee joint angle information may be estimated, restored or reconstructed. A boundary condition set of a knee joint based on a preset gait motion may be formed as a lookup table including a hip boundary condition, a knee boundary condition, and an ankle boundary condition for various walking speeds. The restoring or reconstructing the knee joint information is merely an example for understanding of description, and there is no limitation thereto. Accordingly, joint information that is difficult to sense, for example ankle joint information, may be estimated, restored or reconstructed using the above-described scheme.

Figure 9:
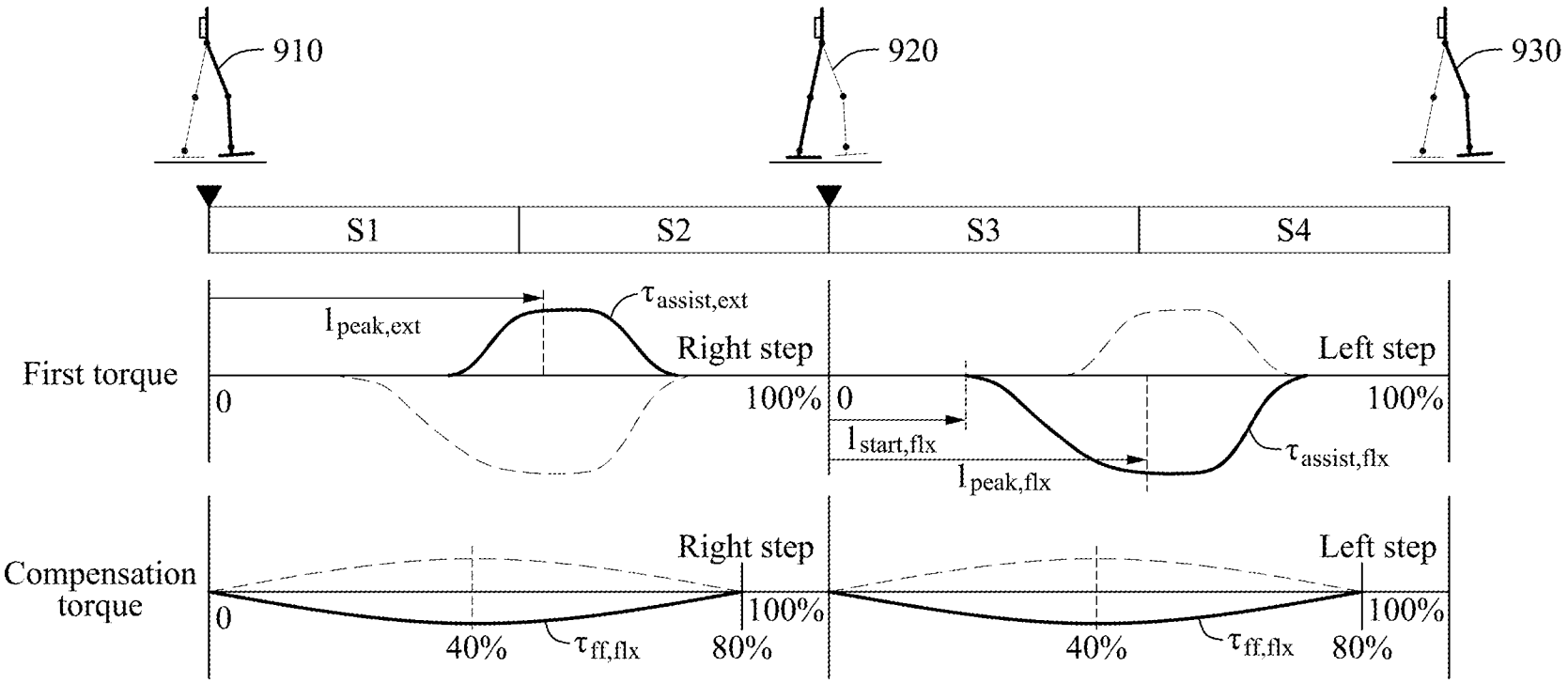
FIG. 9 is a graph illustrating a compensation torque, and a first torque applied to a first leg corresponding to a first step according to some example embodiments.

FIG. 9 is a graph illustrating a compensation torque, and a first torque applied to a first leg corresponding to a first step according to some example embodiments.

The torque generator 320 of FIG. 3 may generate a first torque applied to a first leg corresponding to a detected first step. For example, the torque generator 320 may generate a first torque to assist a standing leg and a swinging leg based on a step cycle when each of steps 910, 920, and 930 starts.

By adding the generated first torque to a compensation torque and a friction compensation torque, a final torque applied to the first leg may be generated. The final torque may be represented as shown in Equation 3 below.

$$\tau_{des}=w_1\tau_{assist}+w_2\tau_{ff}+w_3\tau_{fr} \quad \text{[Equation 3]}$$

In Equation 3, $\tau_{des}$ denotes a final torque applied to the first leg, $\tau_{assist}$ denotes a first torque, $\tau_{ff}$ denotes a compensation torque, and τfr denotes a friction compensation torque. To provide a more precise walking assistance, the generated first torque may be added to the compensation torque and the friction compensation torque and thus the final torque may be generated.

Additionally, wi denoting a compensation counter will be further described with reference to FIG. 13. The compensation counter may be set to prevent a user from being hurt, or falling over, due to a large assistance torque being suddenly applied to the user at an unexpected time. Accordingly, the level of assistance torque may need to be adjusted by estimating the user's current walking situation.

For example, when a walking situation shows a certain level of gait regularity, a preset torque may be provided. On the other hands, when the walking situation does not show certain level of gait regularity, a scaled down torque may be provided. To this end, to generate a final torque applied to the first leg, a value stored in a compensation counter may be multiplied by the first torque, the compensation torque, and the friction compensation torque. A scheme of determining a compensation counter will be further described with reference to FIG. 13.

Figure 10:
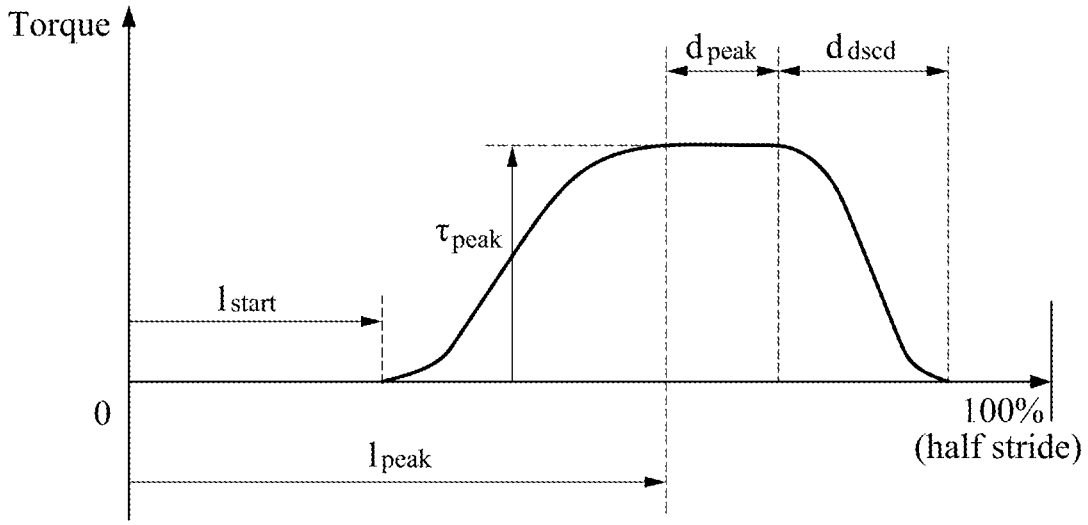
FIG. 10 is a graph illustrating a first torque according to some example embodiments.

FIG. 10 is a graph illustrating a first torque according to some example embodiments.

A first torque generated by the torque generator 320 of FIG. 3 may have a profile of FIG. 10. In FIG. 10, lstart denotes a point in time at which the first torque is applied. As described above, the point in time lstart at which the first torque is applied may be determined as a landing point in time of a foot of a second leg that is opposite to a first leg and that corresponds to a second step. Because the first torque is applied to the first leg at a detected first step, the first torque may need to be applied at a point in time at which the second step transitions to the first step.

A point in time lpeak at which the first torque reaches a peak may be determined as a point in time at which a hip joint angular acceleration of the second leg has a maximum value. Because the second step and the first step sequentially occur, the first step may have continuity with the second step. Accordingly, the point in time at which the hip joint angular acceleration of the second leg has the maximum value during the second step may be determined as a point in time at which the first torque reaches a peak and thus, it is possible to control every step of a user to have regularity.

τpeak denotes a magnitude of a torque when the first torque reaches the peak, dpeak denotes a period of time in which the first torque reaches the peak and is maintained at the peak, and ddsed denotes a period of time in which the first torque reaches the peak and is reduced from the peak. Parameters associated with the above-described profile of the first torque may be determined based on the second torque applied to the second step preceding the first step, for regularity of walking.

Figure 11:
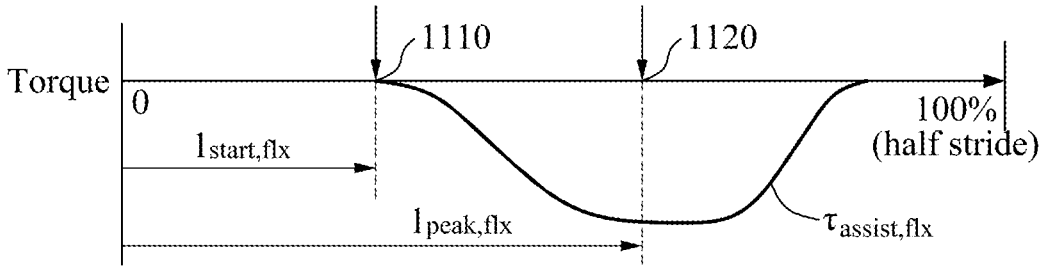
FIG. 11 is a graph illustrating a torque to pull a leg included in a first torque according to some example embodiments.

FIG. 11 is a graph illustrating a pulling torque included in a first torque according to some example embodiments.

FIG. 11 illustrates a pulling torque included in a first torque. As described above, a pulling torque may be generated based on torque information of a second step preceding a first step. For example, a pulling torque in a first torque applied to a first leg corresponding to the first step may be generated based on a second torque applied to a second leg that is opposite to the first leg and that corresponds to the second step.

In FIG. 11, lstart, flx denotes a point in time at which a pulling torque τassist, flx is applied. A point in time at which the pulling torque is applied may be determined as a landing point in time of a foot of the second leg.

Additionally, a point in time lpeak, flx at which the pulling torque reaches a peak may be determined as a point in time 1120 at which a hip joint angular acceleration of the second leg has a maximum value. Because the second step and the first step sequentially occur, the first step may have continuity with the second step. Accordingly, the point in time 1120 may be determined as a point in time at which the first torque reaches a peak and thus, it is possible to control every step of a user to have regularity.

The pulling torque in the first torque may be generated by the torque generator 320, based on torque information of the second step preceding the first step.

Figure 12:
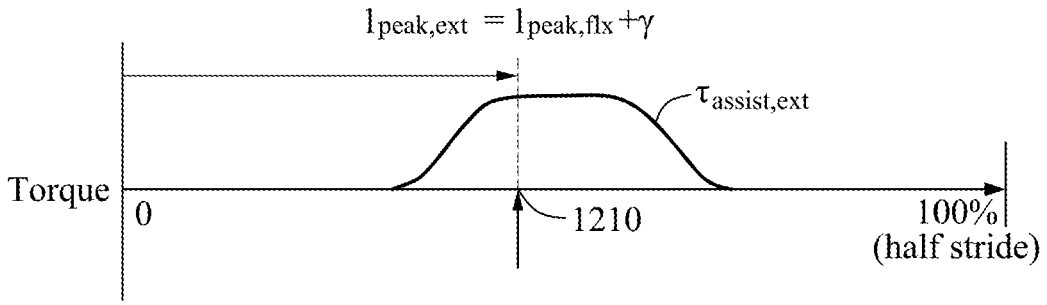
FIG. 12 is a graph illustrating a torque to push a leg included in a first torque according to some example embodiments.

FIG. 12 is a graph illustrating a pushing torque included in a first torque according to some example embodiments.

FIG. 12 illustrates a pushing torque included in the first torque. The pushing torque may be estimated based on a pulling torque.

Unlike with the pulling torque, the pushing torque may has a high probability of suffering from power transfer loss because the first torque is generated in a state in which a great torque is already applied as a force to the user's lower abdomen instead of assisting the pushing torque. Accordingly, in order to increase and/or maximize the effect of the pulling torque, in other words to decrease and/or minimize the reduction in the user's step length (i.e., stride), the pushing torque may be estimated based on the pulling torque.

Figure 13:
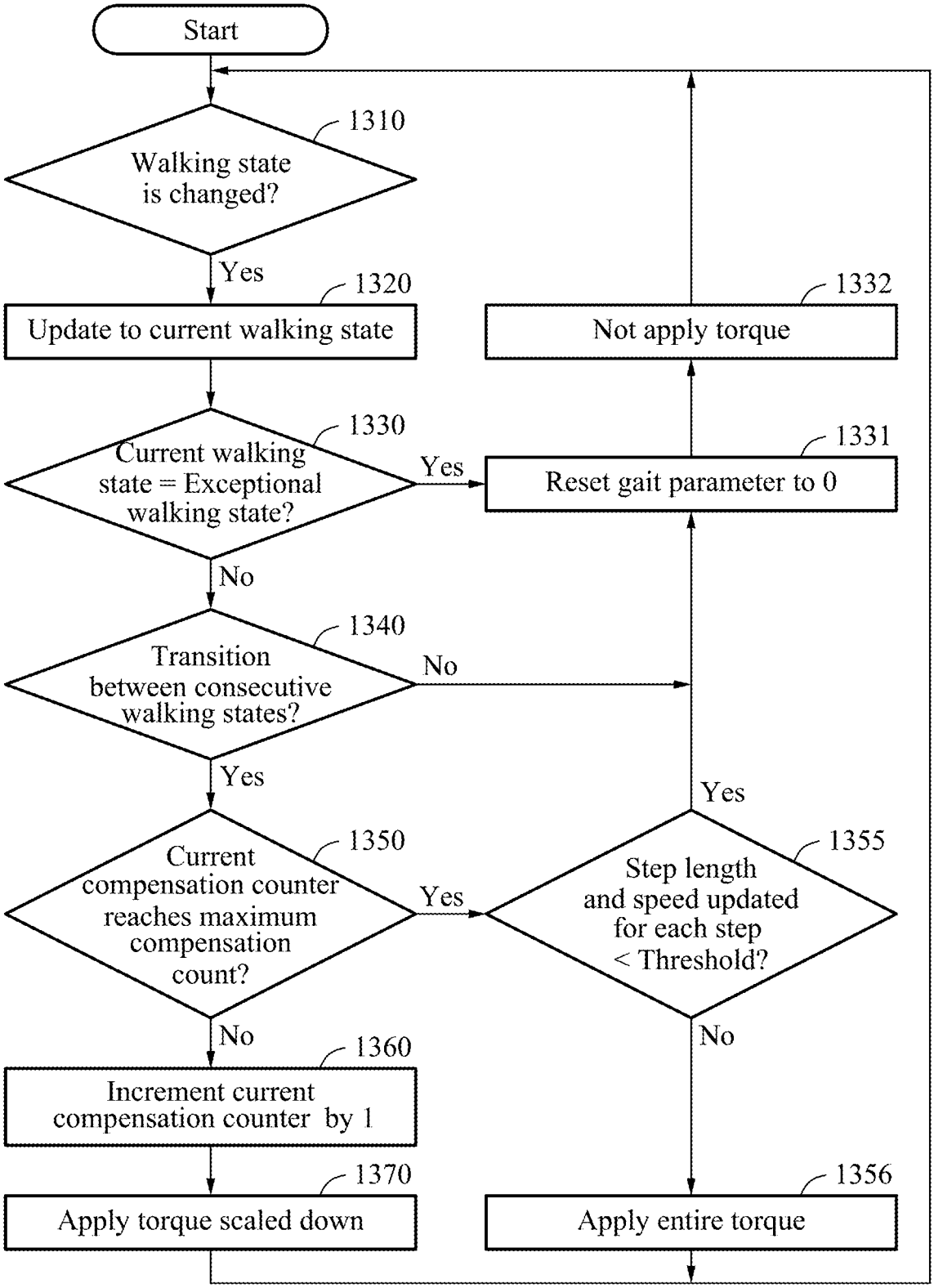
FIG. 13 is a flowchart illustrating a method of scaling down a first torque according to some example embodiments.

FIG. 13 is a flowchart illustrating a method of scaling down a first torque according to some example embodiments.

Referring to FIG. 13, in operation 1310, whether a walking state is changed may be determined. Because the first step may be detected based on a change in the walking state, and a torque to assist the detected first step may be generated, whether the walking state is changed may be determined first.

When the walking state is determined to be changed, a walking state of a user may be updated to the changed walking state, that is, a current walking state in operation 1320. In operation 1330, whether the current walking state is an exceptional walking state may be determined. Because the exceptional walking state does not correspond to a normal gait motion, a gait parameter may need to be adjusted.

When the current walking state is determined to be the exceptional walking state, the gait parameter may be reset to "0" in operation 1331. Because the exceptional walking state is not a normal walking state, a gait parameter in an exceptional state may not be used to generate a torque applied to a following step.

Accordingly, the gait parameter may be reset to "0." Additionally, when the current walking state is determined to be the exceptional walking state, a torque to assist the first step may not be applied in operation 1332. Because the exceptional walking state is not the normal walking state as described above, the torque may not be applied for safety of the user.

When the current walking state is determined not to be the exceptional walking state, determination of whether a transition between consecutive walking states is performed may be determined in operation 1340. When the transition between consecutive walking states is determined not to be performed, the current walking state may be determined not to be the normal walking state, may reset the gait parameter to "0," and may not apply a torque for walking assistance.

In operation 1350, whether a current compensation counter reaches a maximum compensation count defined in advance may be determined. The maximum compensation count may be used to determine whether the walking of the user enters a walking situation showing gait regularity.

For example, when the current compensation counter is determined to reach the maximum compensation count, it may be determined that the walking of the user enters the walking situation showing gait regularity. Conversely, when the current compensation counter is determined not to reach the maximum compensation count, it may be determined that the walking of the user does not enter the walking situation showing gait regularity.

When the current compensation counter is determined not to reach the maximum compensation count, the current compensation counter may be incremented by "1" in operation 1360. Every time the walking state is changed, the current compensation counter may be compared to the maximum compensation count, and whether the walking of the user corresponds to the walking situation showing gait regularity may be determined. When the walking of the user does not correspond to the walking situation showing the gait regularity, the compensation counter may be incremented by "1," and whether the walking of the user corresponds to the walking situation showing the gait regularity may be determined again during switching of a next walking state.

In operation 1370, a torque scaled down may be applied, based on the current compensation counter, because the current compensation counter does not reach the maximum compensation count. Accordingly, it is possible to prevent a great torque from being suddenly applied to the user at an unexpected time.

When the current compensation counter reaches the maximum compensation count, whether a step length and a speed updated for each step is less than a threshold may be determined in operation 1355 in order to recognize a stop while walking. When the step length and the speed updated for each step is determined to be less than the threshold, the current walking state may be determined not to be the normal walking state, may reset the gait parameter to "0," and may not apply the torque for a walking assistance.

When the step length and the speed updated for each step is determined to be equal to or greater than a threshold, the current walking state may be determined to be the normal walking state, and the first torque generated by the torque generator 320 may be applied in operation 1356 instead of scaling down the first torque.

Figure 14:
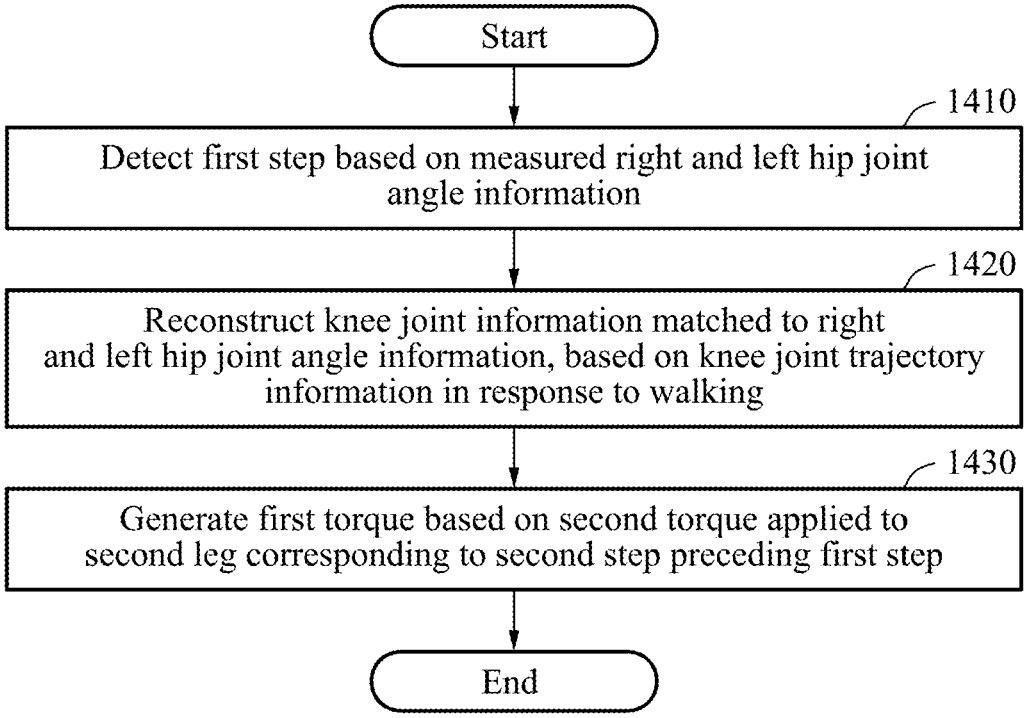
FIG. 14 is a flowchart illustrating a method of controlling a walking assistance apparatus according to some example embodiments.

FIG. 14 is a flowchart illustrating a method of controlling a walking assistance apparatus according to some example embodiments.

Referring to FIG. 14, in operation 1410, the detector 310 of FIG. 3 may detect a first step of a user based on measured right and left hip joint angle information. The detector 310 may detect the first step using an FSM, including walking states based on a gait cycle.

The detector 310 may determine a walking state of the user using the FSM and may detect a point in time every step starts based on the walking state. In other words, the detector 310 may detect a transition from a second step preceding the first step to the first step.

In operation 1420, the reconstructor 330 of FIG. 3 may reconstruct knee joint information matched to the right and left hip joint angle information based on knee joint trajectory information in response to walking.

For example, when it is difficult to measure joint information on another joint, the reconstructor 330 may reconstruct the joint information, based on trajectory information of the other joint that was previously measured and/or may be stored in advance. The reconstructor 330 may restore or reconstruct a motion of the other joint that may not be recognized due to the lack of a sensor.

In operation 1430, the torque generator 320 of FIG. 3 may generate a first torque based on a second torque applied to a second leg corresponding to the second step preceding the first step. In other words, to generate a torque to be applied at a current step, the torque generator 320 may use torque information on a torque applied at a previous step.

The torque generator 320 may determine a profile of the first torque based on the second torque applied at the second step preceding the detected first step. Because the second step and the first step sequentially occur, the first step may have continuity with the second step. Accordingly, the profile of the first torque may be determined based on the second torque.

Additionally, the torque generator 320 may determine, based on the second torque, a point in time when the first torque is applied, a point in time at which the first torque reaches a peak, and a time duration for the first torque. For other parameters that may be useful in generating the first torque, a desired and/or preset value, or a value obtained by modifying and/or optimizing a separate parameter may be used.

The torque generator 320 may determine the point in time when the first torque is applied as a landing point in time of a foot of a second leg that is opposite to a first leg and that corresponds to the second step. The first torque may be applied to the first leg at the detected first step and accordingly may need to be applied at a point in time when the second step transitions to the first step.

The torque generator 320 may determine the point in time at which the first torque reaches the peak as a point in time at which a hip joint angular acceleration of the second leg has a maximum value. As described above, because the second step and the first step sequentially occur, the first step may have continuity with the second step. Accordingly, the point in time at which the hip joint angular acceleration of the second leg has the maximum value may be determined as the point in time at which the first torque reaches the peak and thus, it is possible to control every step of the user to have regularity.

The units and/or modules described herein may be implemented using hardware components, software components, or a combination thereof. For example, the hardware components may include microphones, amplifiers, band-pass filters, audio to digital convertors, and processing devices. A processing device may be implemented using one or more hardware device configured to carry out and/or execute program code by performing arithmetical, logical, and input/output operations. The processing device(s) may include a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors.

The software may include a computer program, a piece of code, an instruction, or some combination thereof, to independently or collectively instruct and/or configure the processing device to operate as desired, thereby transforming the processing device into a special purpose processor. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. While some example embodiments have been particularly shown and described, it will be understood by one of ordinary skill in the art that variations in form and detail may be made therein without departing from the spirit and scope of the claims. Accordingly, other implementations are within the scope of the following claims.

What is claimed is:

1. An apparatus for controlling a walking assistance apparatus, the apparatus comprising:

at least one processor configured to, detect a start of a first step of a user based on right and left hip joint angle information measured using right and left hip joint angle sensors, determine whether the first step is in an exception state, the exception state being an abnormal walking state of a gait cycle of the user, and determine whether a compensation counter has reached a desired compensation count threshold;

a torque generator configured to generate at least one first torque based on at least one second torque, the detected start of the first step, results of the determining whether the first step is in the exception state, and results of the determining whether the compensation counter has reached a desired compensation count threshold, the at least one first torque applied to a first leg of the user corresponding to the first step, and the at least one second torque previously generated by the torque generator and applied to a second leg of the user corresponding to a second step, the second step preceding the first step; and wherein the at least one processor is further configured to, determine the at least one first torque to assist the first step is not applied when the first step is in the exception state, determine the at least one first torque to assist the first step is not applied when a transition between consecutive walking states is not performed, and increment the compensation counter based on the detected start of the first step, the results of the determining whether the first step is in the exception state, and the results of the determining whether the compensation counter has reached the desired compensation count threshold, the incrementing the compensation counter including causing the torque generator to reduce the at least one first torque.

2. The apparatus of claim 1, wherein the at least one processor is configured to detect a step transition from the second step to the first step.

3. The apparatus of claim 1, wherein the torque generator is configured to determine a profile of the at least one first torque, based on the at least one second torque.

4. The apparatus of claim 1, wherein the at least one processor is further configured to determine, based on the at least one second torque, a point in time at which the at least one first torque is applied, a point in time at which the at least one first torque reaches a peak, and a duration of the at least one first torque.

5. The apparatus of claim 4, wherein the at least one processor is further configured to:

reconstruct knee joint information matched to the right and left hip joint angle information based on knee joint trajectory information in response to walking.

6. The apparatus of claim 5, wherein the at least one processor is configured to detect a landing point in time of a foot of the user based on the reconstructed knee joint information.

7. The apparatus of claim 6, wherein the torque generator is configured to determine a point in time at which the at least one first torque is applied as a landing point in time of a foot of the second leg.

8. The apparatus of claim 4, wherein the at least one processor is configured to determine a point in time at which the at least one first torque reaches a peak as a point in time at which a hip joint angular acceleration of the second leg has a maximum value.

9. The apparatus of claim 1, wherein the at least one processor is configured to detect the first step using a finite state machine (FSM), the FSM including FSM states based on the gait cycle of the user.

10. The apparatus of claim 9, wherein a FSM transition condition between the FSM states is set based on right and left hip joint angles or right and left hip joint angular velocities.

11. The apparatus of claim 1, wherein the at least one first torque includes a torque to push one of the first leg or the second leg and a torque to pull the other leg;

the torque to pull the other leg is generated based on the at least one second torque; and the torque to push the one of the first leg or the second leg is estimated based on the torque to pull the other leg.

12. The apparatus of claim 1, wherein the torque generator is configured to reduce the at least one first torque applied to the first leg of the user in response to the compensation counter not reaching the desired compensation count threshold.

13. A method of controlling a walking assistance apparatus, the method comprising:

detecting a start of a first step of a user based on right and left hip joint angle information measured using right and left hip joint angle sensors;

determining whether the first step is in an exception state, the exception state being an abnormal walking state of a gait cycle of the user;

determining whether a compensation counter has reached a desired compensation count threshold, and incrementing the compensation counter based on the detected start of the first step, results of the determining whether the first step is in the exception state, and results of the determining whether the compensation counter has reached the desired compensation count threshold; and generating at least one first torque applied to a first leg of the user corresponding to the first step, wherein the generating includes generating the at least one first torque based on at least one second torque, the detected start of the first step, the results of the determining whether the first step is in the exception state, and the results of the determining whether the compensation counter has reached the desired compensation count threshold, the at least one second torque previously generated by the torque generator and applied to a second leg of the user corresponding to a second step, the second step preceding the first step, and wherein the determining whether the first step is in the exception state includes determining the at least one first torque to assist the first step is not applied when the first step is in the exception state, and determining the at least one first torque to assist the first step is not applied when a transition between consecutive walking states is not performed; and wherein the incrementing the compensation counter further includes causing the torque generator to reduce the at least one first torque.

14. The method of claim 13, wherein the generating includes determining a profile of the at least one first torque based on the at least one second torque.

15. The method of claim 13, wherein the generating includes determining, based on the at least one second torque, a point in time at which the at least one first torque is applied, a point in time at which the at least one first torque reaches a peak, and a duration of the at least one first torque.

16. The method of claim 15, further comprising:

reconstructing knee joint information matched to the right and left hip joint angle information based on knee joint trajectory information in response to walking.

17. The method of claim 16, wherein the detecting includes detecting a landing point in time of a foot of the user based on the reconstructed knee joint information.

18. The method of claim 17, wherein the generating includes determining a point in time at which the at least one first torque is applied as a landing point in time of a foot of the second leg.

19. The method of claim 15, wherein the generating includes determining a point in time at which the at least one first torque reaches a peak as a point in time at which a hip joint angular acceleration of the second leg has a maximum value.

20. The method of claim 13, wherein the detecting includes detecting the first step using a finite state machine (FSM), the FSM including FSM states based on the gait cycle of the user.

* * * * *